United States Patent [19]

Herron et al.

[11] Patent Number: 4,527,494

[45] Date of Patent: Jul. 9, 1985

[54] BOBBIN CASE POSITION PLATE ADJUSTMENT MECHANISM

[75] Inventors: William L. Herron, Elizabeth; John D. Speckman, Colonia, both of N.J.

[73] Assignee: The Singer Company, Stamford, Conn.

[21] Appl. No.: 160,415

[22] Filed: Jun. 18, 1980

Related U.S. Application Data

[63] Continuation-in-part of Ser. No. 4,117, Jan. 17, 1979, abandoned.

[51] Int. Cl.[3] ..... D05B 57/26; D05B 57/08

[52] U.S. Cl. ..... 112/231

[58] Field of Search ..... 112/182, 184, 231, 191

[56] References Cited

U.S. PATENT DOCUMENTS

| | | | |
|---|---|---|---|
| 1,436,460 | 11/1922 | Ringe | 112/184 |
| 2,966,130 | 12/1960 | Johnson | 112/184 |
| 3,023,721 | 3/1962 | Johnson | 112/184 |
| 3,416,472 | 12/1968 | Johnson | 112/184 |
| 3,693,533 | 9/1972 | Ketterer | 112/184 |

FOREIGN PATENT DOCUMENTS

| | | | |
|---|---|---|---|
| 531095 | 7/1955 | Italy | 112/231 |
| 52-74864 | 6/1977 | Japan . | |

*Primary Examiner*—W. C. Reynolds

*Attorney, Agent, or Firm*—Edward P. Schmidt; Robert E. Smith; Edward L. Bell

[57] ABSTRACT

A mechanism for allowing adjustment of a cushion spring assembly to vary the distance between the wall of the bobbin case and the cushion spring in two directions. Means are incorporated to permit movement of the cushion spring assembly to facilitate removal of the bobbin case from the loop taker, without affecting the adjustment of the mechanism.

7 Claims, 5 Drawing Figures

BOBBIN CASE POSITION PLATE ADJUSTMENT MECHANISM

This is a continuation-in-part of Ser. No. 004,117 filed Jan. 17, 1979, now abandoned.

BACKGROUND OF THE INVENTION

1. Field of the Invention

This invention relates to a bobbin case adjustment mechanism, referred to in the sewing machine industry as a cushion spring assembly, for use in a sewing machine having a vertical axis rotary hook.

2. Description of the Prior Art

In a sewing machine that has a vertical axis hook, the bobbin case must be restrained from rotation within the hook while still leaving enough space between the bobbin case and the rotation restraining mechanism to allow a loop of needle thread to pass between the restraining mechanism and the hook during the process of forming stitches.

Some prior bobbin case rotation restraining mechanisms were fastened to the sewing machine bed by screws or similar fasteners that precluded adjusting their positions to correct for errors due to construction and assembly tolerances incurred during the manufacture of the restraining mechanism.

Another prior bobbin case rotation restraining mechanism shown in Japanese Utility Model Application No. 52-74864 incorporated, at one extremity thereof, a stud with an eccentric portion that permitted the mechanism to be pivotally moved toward or away from the bobbin case to effect limited control over the width of a slot located between the bobbin case rotation restraining member and the bobbin case and through which the needle thread must pass during its concatenation with the bobbin thread. While the means for pivotal adjustment incorporated in that mechanism made the machine less prone to thread jamming than rotation restraining mechamisms that did not incorporate adjustment means, the adjustable means can only be adjusted along a limited line, or arc, but cannot be adjusted to all of the points around a closed loop. Such freedom of movement is necessary to allow the cushion spring to be moved in two dimensions relative to the position of the bobbin case to permit accurate setting of the dimensions of more than one part of the slot.

OBJECTS AND SUMMARY OF THE INVENTION

It is an object of this invention to provide a bobbin case rotation restraining mechanism that will permit adjustment of the distance between the bobbin case and the cushion spring by allowing a critical part of the cushion spring assembly to be moved around a closed loop path.

Another object of this invention is to produce a cushion spring assembly that may be easily adjusted in two dimensions after assembly of the sewing machine.

Still another object is to provide a cushion spring assembly that may be easily released to permit the removal of the bobbin case from the loop taker without disturbing the adjustment of the assembly.

Further objects will be apparent from the following description and the accompanying drawings.

The above and other objects are achieved by fastening a cushion spring to a movable bobbin case retainer mechanism that permits adjustments to be made such that a given point on the cushion spring assembly can be moved to any point along a closed loop path relative to the bobbin case. The cushion spring is mounted on a base plate that contains a pair of slots, the directions of elongation of which are substantially orthogonal to each other. One of the slots permits the bobbin case to be moved in a front-or-rear direction relative to the hook, or loop taker. The second elongated slot permits side-to-side arcuate movement toward or away from the hook. The combined effects of the front-rear and arcuate movements constrains any given point on the cushion spring to be placed at any point along a closed loop. A spring biased slide lock engages an eccentric portion of a round, cylindrical stud received by one of the slots to help constrain movement of the cushion spring assembly so that a specific part of the cushion spring can be placed only at any point on a closed loop. The lock also allows the rotation restraining member to be swung away from the bobbin case to simplify removal of the bobbin case from the hook.

DESCRIPTION OF THE PREFERRED EMBODIMENT

Figure 1:
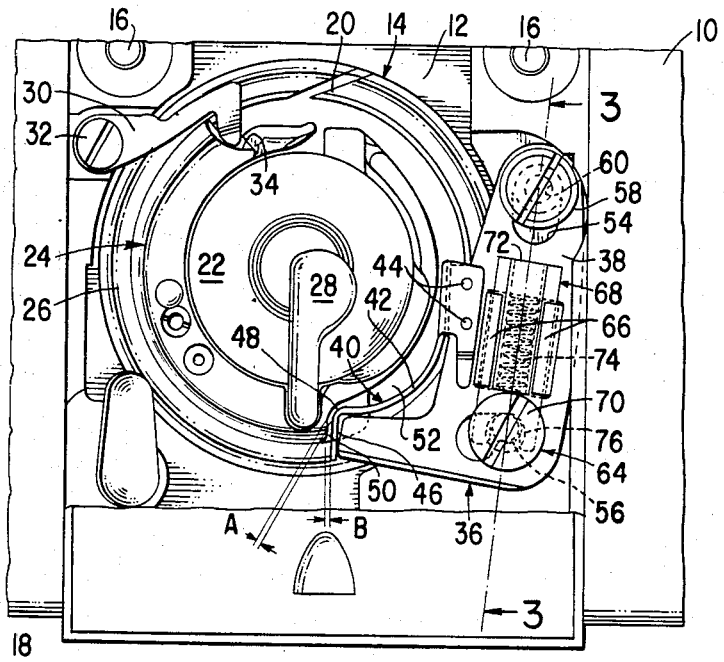
FIG. 1 is a top plan view of a fragment of a sewing machine bed showing a bobbin case within a vertical axis hook and a cushion spring assembly constructed according to this invention.

FIG. 1 shows a portion of a sewing machine bed 10 that includes a recess 12 in which there is a loop taker, or hook, 14 that has a vertical axis. The recess 12 is partly covered during the sewing process by a standard throat plate (not shown) located relative to the bed 10 by a pair of pins 16. The remainder of the recess is covered by a slide plate 18. The hook 14 is rotatably driven in timed relation to reciprocation of a needle, which is not shown, to produce stitches in a well known manner. A more complete description of one type of sewing machine in which the component parts of the present invention may be used is contained in U.S. Pat. No. 3,115,855 issued to S. J. Ketterer. The teachings of the Ketterer patent are incorporated herein by reference.

FIG. 1 also shows that the hook 14 includes a beak 20 that seizes a loop of needle thread from the needle and draws it around a bobbin 22 that contains a supply of bobbin thread, thereby causing the concatenation of the needle thread with the bobbin thread to produce a lockstitch in a well known manner. The bobbin 22 is in a recess within a bobbin case 24 that has a raised wall 26 and is held in that recess by a pivotally movable, spring-biased arm 28, one end of which is fastened to the wall 26 holding the bobbin 22 within the case 24. The arm is shown in its bobbin-retaining position in which it holds the bobbin 22 in the recess in the case 24 but with sufficient freedom to allow the bobbin to rotate freely within the case 24 as bobbin thread is removed to form stitches.

The bobbin case 24 is, in part, restrained from rotating with the hook 14 by a fixed bobbin case rotation restraining member 30, one end of which is fastened to the sewing machine bed 10 by a screw 32 or other suitable fastener. The other end of the fixed rotation restraining member +is contoured to allow thread passage between it and a restraining depression 34 implemented by a substantially radial surface portion in the wall 26 of the bobbin case 24.

The bobbin case 24 is further prevented from rotating with the hook 14 by an adjustable bobbin case retainer, or cushion spring assembly, 36. The assembly 36 includes an elongated base plate 38 to which is fastened a cushion spring 40 constructed of a resilient material, such as spring steel and comprising an arcuate section 42. The cushion spring 40 is secured to the base plate 38 by fasteners, such as a pair of rivets 44. Preferably, the free end 46 of the cushion spring 40 is substantially straight and extends approximately radially with respect to the center of the case 24 and forms an elbow 48 at the point where the free end is bent outwardly from the arcuate section 42. The cushion spring 40 is aligned with, and properly spaced from, a generally radial abutment surface portion 50 in the wall 26 of the bobbin case 24 distant from the depression 34. Preferably the radius of curvature of arcuate section 42 of the cushion spring 40 is large enough to produce a slot 52 of increasing width between the cushion spring and the bobbin case wall 26 so that the cushion spring only contacts the bobbin case 24, if at all, at the interface between the elbow 48 and the abutment surface portion 50 on the bobbin case wall 26. Furthermore, it is essential that free end 46 extend far enough forward (i.e., away from the center of the bobbin case 24) to be sure that each loop of needle thread cannot get past the free end but is forced to move between the free end and the abutment surface portion 50 and on into the slot 52.

The base plate 38 of the cushion spring assembly 36 contains means for adjusting the distances A and B between the bobbin case 24 and the free end 46 and elbow 48, which are key parts of the spring 40. In a typical sewing machine in which the cushion spring assembly 36 can be used, the Singer Model 930, the distance A should be in the range of approximately 0.010" to about 0.014" and the distance B should be in the range from about 0.020" to about 0.060". The adjustment means includes a first slot 54, which is elongated in a direction substantially parallel to a radial line from the abutment surface portion 50 to the center of the case 24, and a second slot 56 elongated in a direction substantially perpendicular in this case to the direction of elongation of the slot 54 and located near the opposite end of the plate 38.

A shouldered screw 58, which constitutes means for fastening the base plate 38 to the bed 10, has the shoulder thereof of such a diameter to just pass through the first elongated slot 54, and is screwed into a threaded hole 60 in the sewing machine bed 10. The bed 10 also has a smooth bore that receives one end of a round cylindrical stud 64, as will be described hereinafter.

The base plate 38 also has a pair of parallel guides 66 that overlap opposite, parallel edges of a spring-loaded slide lock 68, one end of which slides under the head 70 of the stud 64 to lock the cushion spring assembly 36 relative to the bobbin case 24. The slide lock is preferrably made of sheet metal and has a central tunnel portion 72 within which is located a coil spring 74 that presses the lock 68 against the stud 64.

Figure 2:
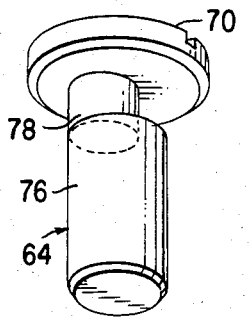
FIG. 2 is an enlarged view of a stud as used in the embodiment in FIG. 1, with, however, a modified eccentric stud applied thereto.

FIG. 2 shows the stud 64 more clearly. The stud includes a main body 76 that is cylindrical, has a circular cross-section, and is concentric with the head 70. An eccentric part 78 in the form of a round cylinder is located between the head 70 and the closer end of the body 76. In this embodiment, the diameter of the eccentric part 78 is smaller than that of the body.

Figure 3:
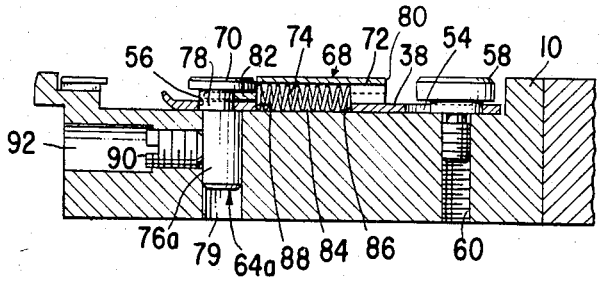
FIG. 3 is a cross-sectional side view taken along the line 3—3 of FIG. 1.

FIG. 3 is a cross-sectional view of the plate 38 held on the bed 10 by the shouldered screw 58 and a modified stud **64*a*. The stud 64*a* differs from the stud 64 in FIG. 2 by having a body portion 76*a* that has a diameter no greater than the diameter of the eccentric portion 78. The latter portion and the head 70 are identical with correspondingly numbered parts in the embodiment in FIG. 2. The body portion 76*a* fits rotatably but not loosely in the smooth bore 79 in the bed 10**.

The tunnel portion 72 of the lock 68 in FIG. 3 is produced by deforming the central part of the sheet metal slide lock 68 between one end 80 and a region 82. The spring 74 is located within a slot 84 in the base plate 38 in line with the slot 54 and bounded by two ends 86 and 88. The spring 74 exerts pressure on the end 86 and on the region 82 to urge the lock toward the eccentric portion 78. The eccentric portion 78 fits snugly within the slot 56 so that turning the head 70 of the stud 64 about its axis, which is common to the axis of the body **76*a*, moves the offset axis of the eccentric portion 78 in a circle and thus moves the plate 38 left and right relative to the position shown in FIG. 3. The plate 38 is shown approximately in its leftmost position (from the point of view of this figure), and so rotation of the head 70 would move the plate 38 to the right, but continued rotation would move it back to the left. A set screw 90 in a threaded hole 92 in the bed 10 can be tightened against the body 76*a* to hold the stud 64*a*, and therefore the plate 38, fixed in any position within the range of physically possible positions determined by the crank arm offset between the axis of the body 76*a* and the axis of the eccentric portion 78**.

Figure 4:
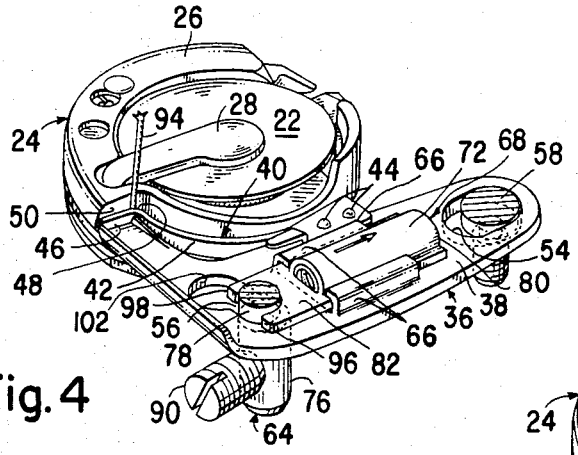
FIG. 4 is a perspective view of the bobbin case and cushion spring assembly of FIG. 1 in operating position.

FIG. 4 shows the cushion spring assembly 36 in its operating position adjacent the bobbin case 24 but does not show the bed 10. In the operating position of the cushion spring assembly 36, the eccentric portion 78 of the stud 64 fits within the controlling part of the second slot 56, as shown in FIG. 4, to effect limited movement of the cushion spring assembly along the length of the first slot 54 as well as movement of the second slot 56 and cushion spring 40 towards and away from the abutment surface portion 50. A loop of thread 94 that has been cast off from the hook 14 during the formation of a stitch is shown passing through the slot 52 as the loop is being drawn about the bobbin case 24. The free end 46 of the cushion spring 40 insures that the thread is smoothly guided into the slot 52. It will best be appreciated from a review of FIG. 1 that, when the free end 46 of the cushion spring 40 is in position against the abutment surface portion 50, the bobbin case 24 will be restrained from rotating with the hook 14 by the combined effects of the fixed bobbin case rotation restraining member 30 and the free end 46 of the cushion spring 40 carried on the adjustable bobbin case retainer 36.

In order to adjust the spacing of the cushion spring 40 from the bobbin case 24, the set screw 90 is loosened to allow the stud 64 to be rotated. As indicated in FIG. 3, the main body portion 76 of the stud fits rotatably but not loosely in a smooth bore that holds the axis of the main body portion virtually fixed as the stud 64a rotates. The smooth bore 79 is not shown in FIG. 4, but it is to be understood that the body portion 76 of the stud 64 is located in such a bore. As a result, rotation of the stud 64 causes the eccentric portion 78 to move in a circular path centered on the axis of the main body portion 76 therein.

As the eccentric portion 78 is caused to follow a circular path of rotation of the stud 64, the plate 38 is moved back and forth in the direction of elongation of the slot 54, guided by the shouldered screw 58. This tends to move the end 46 of the cushion spring 40 more or less parallel to the abutment surface portion 50 on the wall of the bobbin case 24.

The end of the slide lock 68 that engages the eccentric portion 78 is shown to be bifurcated so that it has two points 96 and 98 separated by a distance substantially equal to the diameter of the eccentric portion 78. The slide lock 68 is constrained by the parallel guide 66 so that it can only move back and forth in the direction of the guides 66, which corresponds to the direction of elongation of the slot 54. This means that, as the stud 64 is rotated, not only does the base plate 38 have to move back and forth in the direction of the slot 54 but it also has to occupy a position such that the two points 96 and 98 at the end of the spring lock 68 can fit on opposite sides of the eccentric portion 78 to maintain the eccentric portion in the controlling part of the slot 56. Thus, although the cushion spring assembly 36 can be adjusted to move the elbow 48 parallel to the wall portion 50 to a point as close to the wall 26 as may be desired by moving the base plate 38 in the direction of elongation of the slot 54, engagement of the slide lock 68 with the eccentric portion 78 allows end portion 46 to be held in only certain positions. The net result is that the point within the base plate 38 that is midway between the two side walls of the slot 56 and is also midway between the two points 96 and 98 of the slide lock 68 is constrained so that it must move in a circle as the stud 64 rotates.

At the same time, the portion of the base plate 38 that defines the slot 54 undergoes a different motion, moving back and forth in the direction of elongation of the slot 54 and pivoting slightly from side to side. Other points of the cushion spring assembly 36 not aligned with the slot 54, for example the elbow 48 of the cushion spring, itself, move in a closed loop, which is essentially an ellipse. This gives the elbow 48 greater freedom of motion than if it were limited to just a straight line or an open arc and facilitates placing the elbow within the desired ranges of both A and B in FIG. 1.

Figure 5:
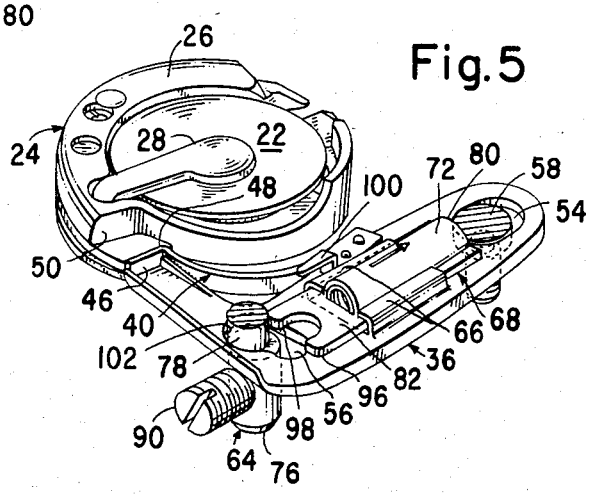
FIG. 5 shows the apparatus in FIG. 4 with the cushion spring assembly moved away form the bobbin case.

FIG. 5 shows the apparatus of FIG. 4 with the cushion spring assembly 36 pivoted aside in order to allow the bobbin case 24 to be removed. In order to move the cushion spring assembly to the position shown in FIG. 5 without disturbing the eccentric adjustment means, the slide lock 68 is simply pushed toward the shouldered screw 58 so as to allow the point 98 to clear the eccentric portion 78 of the stud 64. An extension 100 on the cushion spring 40 serves as a handle to permit the entire cushion spring assembly 36 to be moved away from the bobbin case 24. As will be noticed, the cushion spring assembly 36 has been moved so that the eccentric portion 78 of the stud 64 no longer passes through the narrow part of the slot 56 but through an enlarged part 102 at one end of the slot. The purpose of this enlarged part is to allow the main body 76 of the stud to be inserted through it during assembly of the components. Since both the body 76 and the head 70 (FIG. 2) are larger in diameter than the eccentric portion 78, and yet the eccentric portion must fit relatively snuggly in the slot 56, an enlarged opening must be provided, and it is convenient that this opening be the part 102 at the end of the slot 56.

The whole purpose of the slot 56 is to make it possible to adjust the position of the cushion spring 40 but by only a relatively small distance. Thus, the slot 56 need not be very long. In order to keep the sliding lock 68 from slipping forward and out of position when the cushion spring assembly is pivoted to the position shown in FIG. 5, it is desirable that the point 98 engage the eccentric portion 78 when the components are placed as shown in FIG. 5. By limiting the slot 56 so that this contact between the point 98 and the eccentric portion 78 will take place even in the most extreme position of the cushion spring assembly 36, the sliding lock 68 will be held safely in position at all times.

While this invention has been described in terms of specific embodiments, it will be understood by those skilled in the art that modifications may be made therein within the scope of the following claims.

We claim:

1. In a sewing machine comprising a bed, a loop taker rotating on a vertical axis within the bed, a fixed bobbin case rotation restraining member fastened to the bed, and a bobbin case contained within said loop taker, the bobbin case containing a bobbin carrying a supply of bobbin thread and having an outwardly facing wall containing a depression and an abutment surface located on the wall distant from the depression, the depression entrapping the fixed bobbin case rotation restraining member to prevent the bobbin case from partaking of rotation with the loop taker:

an adjustable bobbin case retainer;

a second rotation restraining member carried on the adjustable bobbin case retainer and cooperating with the fixed rotation restraining member to prevent rotation of the bobbin case, the adjustable bobbin case retainer comprising a base plate containing a first elongated slot and a second elongated slot near opposite extremities of the base plate, the slots being elongated in directions which are substantially perpendicular to each other;

first means for pivotally fastening the base plate to the sewing machine bed through the first of the slots to pivot the second rotation restraining member toward and away from the abutment surface, the first slot being elongated in a direction substantially parallel to the abutment surface to allow movement of the retainer in a direction substantially parallel to the abutment surface;

second means cooperating with and closely fitting against the sides of the second of the elongated slots for eccentrically adjusting the distance of the base plate relative to the loop taker, whereby the distance between the bobbin case and the second rotation restraining member carried on the base plate may be adjusted in a direction generally parallel to the direction of the abutment surface by the eccentric adjusting means and the pivotal fastening means; and third means cooperating with the second means and the sides of the second elongated slot to lock the rotation restraining member carried on the base plate at predetermined points at different perpendicular distances from the abutment surface.

2. The adjustable bobbin case retainer as set forth in claim 1 wherein the means for eccentrically adjusting the base plate comprises a stud having an eccentric portion that closely fits between the sides of the second elongated slot, the stud being fastened to the sewing machine bed, the eccentric portion passing through the second of the elongated slots for imparting movement to the base plate in the direction of elongation of the first slot when the stud is rotated.

3. The adjustable bobbin case retainer as set forth in claim 1 in which the third means comprises spring-biased means slidably mounted on the base plate to slide substantially parallel to the axis of the first slot, the spring-biased means comprising a bifurcated extremity to engage the eccentric adjusting means to lock the bobbin case retainer relative to the bobbin case and to allow movement of the retainer away from the bobbin case to effect removal of the bobbin case from the loop taker without disturbing the eccentric adjusting means.

4. A sewing machine comprising:

a rotatable loop taker;

a generally round bobbin case within the loop taker and comprising first and second generally radial, spaced surface portions;

a fixed bobbin case rotation restraining member extending into a position adjacent the first surface portion of the bobbin case to prevent rotation of the bobbin case, but sufficiently spaced from the bobbin case to allow thread to pass between the fixed bobbin case rotation restraining member and the first surface portion;

an adjustable bobbin case retainer comprising a base plate, a cushion spring mounted on the base plate and extending adjacent the second surface portion of the of the bobbin case to prevent rotational movement of the bobbin case, but spaced sufficiently from the second surface portion to permit thread to pass between the cushion spring and the second surface portion of the bobbin case;

fixed support means for the loop taker, the fixed bobbin case rotation restraining member, and the adjustable bobbin case retainer;

first pin and slot means comprising a first pin and a first slot connecting the support means and the adjustable bobbin case retainer, the slot means extending in a first direction to permit movement of the adjustable bobbin case retainer substantially parallel to the generally radial second surface portion and the support means in the first direction to vary the distance between the cushion spring and the bobbin case in that direction, the first pin having a circular portion of substantially the same diameter as the width of the first slot;

second pin and slot means connecting the support means and the adjustable bobbin case retainer, the second pin and slot means comprising a second pin comprising an eccentric portion to control the relative position of the adjustable bobbin case retainer with respect to the support means by controlling the relative location of the first pin in the first slot by rotation of the eccentric portion of the second pin, and a second slot having a direction of elongation at an angle to the direction of the first slot, the eccentric portion of the second pin fitting slidably within a controlling part of the second slot to permit limited movement of the adjustable bobbin case retainer also in a second direction corresponding to the direction of elongation of the second slot when the eccentric portion of the second pin is embraced by the controlling part of the second slot; and slidable means mounted on the adjustable bobbin case retainer to move relatively perpendicularly with respect to the direction of elongation of the second slot to engage the pin in the second pin and slot means and fix the position of the adjustable bobbin case retainer during operation of the machine.

5. The invention as defined in claim 4 in which said first pin of said first pin and slot means is held in said support means, and in which said first slot is formed in said adjustable bobbin case retainer, the first slot being so oriented that, when the adjustable bobbin case retainer is in position with the first pin inserted through the first slot, the first slot extends generally parallel to a radial line between the bobbin case and the second surface portion of the bobbin case.

6. The invention as defined in claim 5 in which said second pin of said second pin and slot means is mounted in said support means, and in which said second slot is formed in said adjustable bobbin case retainer, the controlling part of the second slot extending substantially perpendicular to the first slot.

7. The invention as defined in claim 6 in which the eccentric pin comprises a first cylindrical portion rotatably held in the support means and a second cylindrical portion eccentrically offset with respect to the first portion and extending through the second slot, the second slot having an enlarged part large enough for the first cylindrical portion of the eccentric pin to fit therethrough.

* * * * *